US011569608B2

(12) United States Patent
Czyz et al.

(10) Patent No.: US 11,569,608 B2
(45) Date of Patent: Jan. 31, 2023

(54) ELECTRICAL CONNECTOR SYSTEM

(71) Applicants: Robert Anthony Czyz, Schaumburg, IL (US); Anthony S. Czyz, Schaumburg, IL (US); John Regole, Oakland Charter Township, MI (US)

(72) Inventors: Robert Anthony Czyz, Schaumburg, IL (US); Anthony S. Czyz, Schaumburg, IL (US); John Regole, Oakland Charter Township, MI (US)

(73) Assignees: NORTHROP GRUMMAN SYSTEMS CORPORATION, Falls Church, VA (US); ICONN SYSTEMS, INC., Lombard, IL (US)

( * ) Notice: Subject to any disclaimer, the term of this patent is extended or adjusted under 35 U.S.C. 154(b) by 6 days.

(21) Appl. No.: 17/217,099

(22) Filed: Mar. 30, 2021

(65) Prior Publication Data

US 2022/0320788 A1 Oct. 6, 2022

(51) Int. Cl.
*H01R 13/523* (2006.01)
*H01R 24/86* (2011.01)
(Continued)

(52) U.S. Cl.
CPC ..... *H01R 13/523* (2013.01); *H01R 13/03* (2013.01); *H01R 13/22* (2013.01); *H01R 13/64* (2013.01); *H01R 24/86* (2013.01)

(58) Field of Classification Search
CPC ..... H01R 13/523; H01R 13/03; H01R 13/22; H01R 24/86
See application file for complete search history.

(56) References Cited

U.S. PATENT DOCUMENTS 110,422 A 12/1870 Beau
3,475,795 A 11/1969 Youngblood
(Continued)

FOREIGN PATENT DOCUMENTS

CN 112470348 A 3/2021
EP 2728983 A1 5/2014
(Continued)

OTHER PUBLICATIONS

"Wet-Mate-Connector-Study"; found on the internet Apr. 14, 2020 at https://ore.catapult.org.uk/app/uploads/2018/01/Wet-mate-connector-study.pdf.

(Continued)

*Primary Examiner* — Briggitte R. Hammond
(74) *Attorney, Agent, or Firm* — Tarolli, Sundheim, Covell & Tummino LLP

(57) ABSTRACT

An electrical connector system includes a first connector comprising first contacts and a plurality of contact guides associated with the respective first contacts. The system also includes a second connector comprising second contacts configured to slide between a respective one of the contact guides and a respective one of the first contacts in response to joining the first and second connectors as a mated pair. Each respective contact guide provides contact pressure to a first surface of the respective one of the second contacts to provide a biasing force of the second contact onto the first contact to electrically couple a second surface of the respective one of the second contacts opposite the first side to an adjoining surface of the respective one of the first contacts to conduct a signal between the respective one of each of the first and second contacts.

20 Claims, 5 Drawing Sheets

(51) Int. Cl.

| | |
|---|---|
| ***H01R 13/03*** | (2006.01) |
| ***H01R 13/64*** | (2006.01) |
| ***H01R 13/22*** | (2006.01) |

(56) References Cited

U.S. PATENT DOCUMENTS

| | | | | |
|---|---|---|---|---|
| 4,160,609 | A | 7/1979 | Jackson et al. | |
| 4,338,149 | A | 7/1982 | Quaschner | |
| 4,466,184 | A | 8/1984 | Cuneo et al. | |
| 4,687,695 | A | 8/1987 | Hamby | |
| 4,715,928 | A | 12/1987 | Hamby | |
| 4,737,118 | A * | 4/1988 | Lockard | H01R 24/84 439/594 |
| 5,130,691 | A | 7/1992 | Shintaku et al. | |
| 5,160,269 | A | 11/1992 | Fox, Jr. et al. | |
| 5,161,981 | A | 11/1992 | Deak et al. | |
| 5,419,038 | A | 5/1995 | Wang et al. | |
| 5,854,534 | A | 12/1998 | Beilin et al. | |
| 6,040,624 | A | 3/2000 | Chambers et al. | |
| 6,603,079 | B2 | 8/2003 | Biron | |
| 6,793,544 | B2 | 9/2004 | Brady et al. | |
| 6,924,551 | B2 | 8/2005 | Rumer et al. | |
| 7,012,812 | B2 | 3/2006 | Haba | |
| 7,251,712 | B2 | 7/2007 | Unno | |
| 7,407,408 | B1 | 8/2008 | Taylor | |
| 7,911,029 | B2 | 3/2011 | Cui | |
| 8,118,611 | B2 | 2/2012 | Jeon | |
| 8,135,281 | B2 | 3/2012 | Zhovnirovsky et al. | |
| 8,262,873 | B2 | 9/2012 | Wurm et al. | |
| 8,359,738 | B2 | 1/2013 | Takahashi et al. | |
| 9,197,006 | B2 | 11/2015 | Hack | |
| 9,485,860 | B2 | 11/2016 | Yosui | |
| 9,743,529 | B2 | 8/2017 | Lee et al. | |
| 9,847,632 | B2 | 12/2017 | Zivi et al. | |
| 9,893,460 | B2 | 2/2018 | Windgassen et al. | |
| 10,355,334 | B2 | 7/2019 | Bokenfohr et al. | |
| 10,681,812 | B2 | 6/2020 | Hartman | |
| 11,075,486 | B1 * | 7/2021 | Hack | H01R 13/035 |
| 11,276,963 | B2 | 3/2022 | Shimizu | |
| 2003/0114026 | A1 | 6/2003 | Caldwell | |
| 2004/0038072 | A1 * | 2/2004 | Miura | H01R 13/03 428/673 |
| 2004/0043675 | A1 | 3/2004 | Hiatt et al. | |
| 2004/0049914 | A1 | 3/2004 | Wang et al. | |
| 2008/0124033 | A1 | 5/2008 | Gurreri et al. | |
| 2009/0014205 | A1 | 1/2009 | Kobayashi et al. | |
| 2009/0269957 | A1 | 10/2009 | Bloomfield | |
| 2010/0063555 | A1 | 3/2010 | Janzig et al. | |
| 2010/0112833 | A1 | 5/2010 | Jeon | |
| 2012/0042481 | A1 | 2/2012 | Kempf | |
| 2013/0089290 | A1 | 4/2013 | Sloey et al. | |
| 2013/0196855 | A1 | 8/2013 | Poletto et al. | |
| 2014/0175671 | A1 | 6/2014 | Haba et al. | |
| 2014/0353014 | A1 | 12/2014 | Lai | |
| 2014/0364004 | A1 | 12/2014 | Oniki | |
| 2015/0011107 | A1 | 1/2015 | Hack | |
| 2015/0055914 | A1 | 2/2015 | Dell Anno et al. | |
| 2015/0079829 | A1 * | 3/2015 | Brodsgaard | H01R 24/84 439/284 |
| 2016/0014893 | A1 | 1/2016 | Yosui | |
| 2016/0087379 | A1 | 3/2016 | Tanaka | |
| 2016/0100012 | A1 | 4/2016 | Haugseth et al. | |
| 2016/0233607 | A1 | 8/2016 | Windgassen et al. | |
| 2017/0149231 | A1 | 5/2017 | Zivi et al. | |
| 2018/0160304 | A1 | 6/2018 | Liu et al. | |
| 2018/0168042 | A1 | 6/2018 | Hartman | |
| 2018/0205191 | A1 | 7/2018 | Wimmer et al. | |
| 2019/0027800 | A1 | 1/2019 | El Bouayadi et al. | |
| 2019/0074568 | A1 | 3/2019 | Henry et al. | |
| 2019/0313530 | A1 | 10/2019 | Hartman | |
| 2020/0006655 | A1 | 1/2020 | Tang et al. | |
| 2020/0069855 | A1 | 3/2020 | Matthes et al. | |
| 2020/0083927 | A1 | 3/2020 | Henry et al. | |
| 2020/0153149 | A1 | 5/2020 | Tanaka et al. | |
| 2021/0336390 | A1 | 10/2021 | Shimizu | |

FOREIGN PATENT DOCUMENTS

| | | | |
|---|---|---|---|
| JP | S5830174 | A | 2/1983 |
| JP | 2002064271 | A | 2/2002 |
| JP | 2019212470 | A | 12/2019 |
| WO | 2004070734 | A1 | 8/2004 |
| WO | 2006/132108 | | 12/2006 |
| WO | 2018228897 | A1 | 12/2018 |
| WO | 2019/096655 | | 5/2019 |

OTHER PUBLICATIONS

Brown et al.: "Development, Testing and Track Record of Multi-Way Underwater Mateable Fiber-Optic Connectors for Deepwater Applications"; Copyright 2002, Offshore Technology Conference This paper was prepared for presentation at the 2002 Offshore Technology Conference held in Houston, Texas U.S.A., May 6-9, 2002.

International Search Report for Application No. PCT/US2020/054257 dated Jan. 21, 2021.

Japanese Office Action for Application No. 2019-528086 dated Jul. 21, 2020.

Kaushal et al.: "Tree Space Optical Communication: Challenges and Mitigation Techniques"; Department of Electrical, Electronics and Communication Engineering, ITM University, Gurgaon, Haryana, India-122017. Département de génie électrique, École de technologie supérieure, Montréal (Qc), Canada; Jun. 16, 2015.

Korean Office Action for Application No. 10-2019-7015946 dated Jan. 28, 2021.

Mabrouk et al.: "Experimental Validation of Receiver Sensitivity for 100-Mbps Data Rates in Seawater by Using 2.4 GHz-Low-Power Electronics"; International Journal on Communications Antenna and Propagation (I.Re.C.A.P.), vol. 9, N. 1 ISSN 2039-5086 Feb. 2019.

Mendez et al.: "A Comparative Study of Underwater Wireless Optical Communication for Three Different Communication Links"; IOSR Journal of Electronics and Communication Engineering (IOSR-JECE) e-ISSN: 2278-2834,p—ISSN: 2278-8735.vol. 10, Issue 3, Ver. II (May-Jun. 2015), pp. 40-48 www.iosrjournals.org.

Non Final Office Action for U.S. Appl. No. 15/930,596 dated Feb. 2, 2021.

RMS Pump Tools: Subsea Wet-Mate & Dry-Mate Connector Systems: found on the internet on Apr. 14, 2020 at: http://www.rmspumptools.com/perch/resources/brochures/subsea-connectors-1.pdf.

International Search Report for Application No. PCT/US2021/015083 dated Apr. 13, 2021.

International Search Report & Written Opinion for corresponding PCT/US2022/016953, dated Jun. 2, 2022.

Office Action dated Nov. 8, 2022 for corresponding Taiwan Patent Application serial No. 111106806.

* cited by examiner

ELECTRICAL CONNECTOR SYSTEM

TECHNICAL FIELD

The present disclosure relates generally to electrical systems, and specifically to an electrical connector system.

BACKGROUND

Signal connectors that provide electrical connection between a pair of wires are necessary in nearly every piece of wired communications environment. There are numerous environmental challenges that can arise from ensuring connection of wires over long distances, such as to facilitate the use of signal connectors. One such environmental challenge includes the use of signal connectors in environments that can provide electrical conduction in ambient conditions. For example, electrical connections may be required in environments such as in fluids, such as water (e.g., seawater), that may create challenges in ensuring that separate signal conductors do not experience conduction between each other. Such conduction can lead to noise and/or cross-talk in the respective signals that are transmitted. Some connectors that can be implemented in such environments may be formed of non-traditional conductive materials. However, such materials, while potentially solving some of the environmental challenges, can introduce new challenges in such environments.

SUMMARY

One example includes an electrical connector system. The system includes a first connector comprising a plurality of first contacts formed from a metal and a plurality of contact guides associated with the respective plurality of first contacts. The system also includes a second connector comprising a plurality of second contacts formed from the metal and configured to slide between a respective one of the contact guides and a respective one of the first contacts in response to joining the first and second connectors as a mated pair. The respective one of the contact guides provides contact pressure via the respective one of the contact guides to a first surface of the respective one of the second contacts to provide a biasing force of the second contact onto the first contact to electrically couple a second surface of the respective one of the second contacts opposite the first side to an adjoining surface of the respective one of the first contacts to conduct a signal between the respective one of each of the first and second contacts.

Another example includes an electrical connector system. The system includes a first connector comprising a plurality of first contacts formed from a metal and a plurality of contact guides associated with the respective plurality of first contacts. The system also includes a second connector comprising a plurality of second contacts formed from the metal and a plurality of support guides. The second contacts are configured to slide between a respective one of the contact guides and a respective one of the first contacts in response to joining the first and second connectors as a mated pair. Each of the support guides provides contact with a respective one of the contact guides in response to joining the first and second connectors as a mated pair to provide contact pressure via the respective one of the contact guides to a first surface of the respective one of the second contacts to electrically couple a second surface of the respective one of the second contacts opposite the first side to an adjoining surface of the respective one of the first contacts to conduct a signal between the respective one of each of the first and second contacts.

Another example includes an electrical connector system. The system includes a first connector comprising a first housing, a plurality of first contacts formed from a self-passivating transition metal, and a plurality of contact guides associated with the respective plurality of first contacts. The system also includes a second connector comprising a second housing and a plurality of second contacts formed from the self-passivating transition metal and configured to slide between a respective one of the contact guides and a respective one of the first contacts in response to joining the first and second connectors via the first and second housings as a mated pair. The respective one of the contact guides provides contact pressure to a first surface of the respective one of the second contacts to provide a biasing force of the second contact onto the first contact to electrically couple a second surface of the respective one of the second contacts opposite the first side to an adjoining surface of the respective one of the first contacts to conduct a signal between the respective one of each of the first and second contacts, wherein the first and second housings are configured to substantially enclose the electrical connector system and to create at least one fluid-filled channel between each of the electrically-connected first and second contact pairs in response to joining the first and second connectors via the first and second housings as the mated pair while submerged in a respective fluid to provide a resistive path in the at least one fluid-filled channel for providing signal isolation between each of the electrically-connected first and second contact pairs.

DETAILED DESCRIPTION

Figure 1:
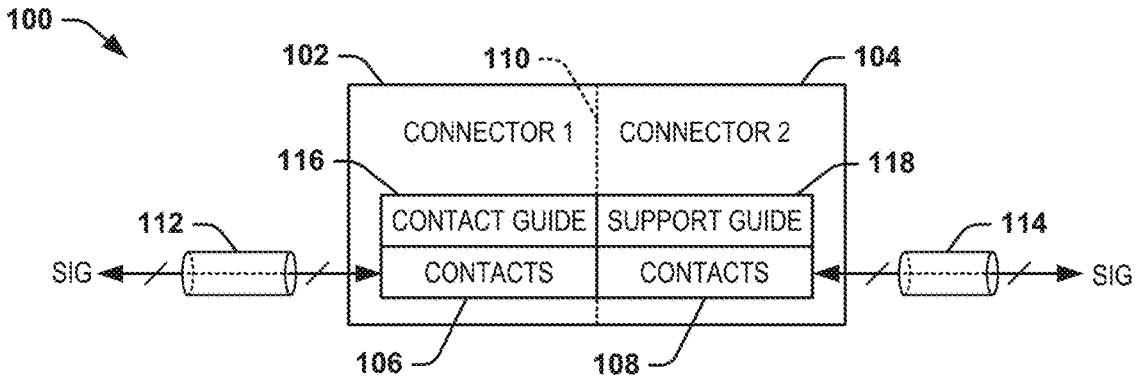
FIG. 1 illustrates an example diagram of an electrical connector system.

The present disclosure relates generally to electrical systems, and specifically to an electrical connector system. The electrical connector system can be implemented in any of a variety of applications to provide a connection point for conductors (e.g., wires) that can each propagate a power signal or an alternating current (AC) communication signal (hereinafter, "AC signal(s)"). As described herein, the term "power signal" can refer to a DC or AC current. As also described herein, the term "AC signal" can refer to any variable amplitude signal, and is not limited to periodic or high-speed communications signals (e.g., radio frequency (RF) signals). The electrical connector system includes a first connector and a second connector. As an example, the electrical connector system can be implemented in an environment in which traditional connectors cannot be employed, such as in fluids. For example, the electrical connector system can be implemented in an environment in which the first and second connectors can be connected with each other to form the electrical connector system in such a non-traditional connection environment, such as submerged in a fluid (e.g., water). As an example, the first and second connectors can each be separately submerged in the fluid before being coupled together. As described herein, the electrical connector system can be fabricated and arranged to facilitate propagation of separate power and/or AC signals on separate respective conductors in the fluid without experiencing short-circuits, noise, and/or cross-talk between the separate respective conductors.

The first connector includes a first housing, and also includes a plurality of first contacts formed from a metal, such as a self-passivating transition metal. Each of the first contacts can be configured to conduct one of the power or AC signals. Similarly, the second connector includes a second housing and a plurality of second contacts formed from metal, such as the self-passivating transition metal. For example, the self-passivating transition metal can be any of niobium, tantalum, titanium, zirconium, molybdenum, ruthenium, rhodium, palladium, hafnium, tungsten, rhenium, osmium, and iridium. Each of the second contacts can be configured to electrically couple to a respective one of the first contacts to conduct the power or AC signal.

The first connector can also include a plurality of pliable contact guides (hereinafter "contact guides") that are each associated with one of the first contacts. As an example, the contact guides can be formed from a pliable or semi-elastic material to provide flexibility of the contact guides. The contact guides can include a tapered or non-linear leading edge (e.g., at a distal end) that is configured to contact the respective second contact when the first and second connectors are joined to form a mated pair. As described herein, the term "mated pair" refers to the connection of the first and second connectors to provide electrical connectivity between each of the first and second contacts. The tapered or non-linear leading edge thus facilitates elastic motion of the contact guide over the edge of the second contact as the second contact slides along the first contact to move into engagement with a first surface of the second contact. The contact guides can thus provide contact pressure on the first surface of the second contact to provide a biasing force of the second contact onto the first contact to provide electrical connectivity of a second surface of the second contact, opposite the first surface, with an adjoining surface of the first contact.

For example, when submerged in the fluid (e.g., water), the contacts develop a dielectric film that acts as a high-capacitance capacitor between the self-passivating transition metal and the fluid. For direct current (DC) signals, the high DC resistance of the dielectric film thus provides insulation between the separate contacts in the fluid. However, the dielectric film can provide a barrier that can inhibit electrical connectivity between the first and second contacts. Additionally, self-passivating transition metals can be relatively soft and pliable, and can therefore provide unpredictable electrical coupling between contacts. Therefore, based on the provided contact pressure from the contact guide, the dielectric film can be scraped from the adjoining surfaces of the respective first and second contacts, and the first and second contacts can be pressed together to provide uniformity of electrical contact as the first and second connectors are joined to form the mated pair. As another example, the second connector can include a support guide that can provide contact with the contact guide (e.g., at a portion along the length of the contact guide) to provide the contact pressure as a predetermined force to the first surface of the second contact via the contact guide. As a result, the electrical connection of the first and second contacts can be sufficient based on mitigating the inhibition of the power or AC signal propagating between the first and second contacts based on the dielectric film and/or poor surface contact.

FIG. 1 illustrates an example of an electrical connector system 100. The electrical connector system 100 can be implemented in any of a variety of applications to provide a connection point for conductors (e.g., wires) that can each propagate an alternating current (AC) signal. As described herein, the electrical connector system 100 can be implemented in an environment that may require submersion of the electrical connector system 100, such as in water (e.g., seawater).

The electrical connector system 100 includes a first connector ("CONNECTOR 1") 102 and a second connector ("CONNECTOR 2") 104. The first connector 102 includes a plurality of first contacts ("CONTACTS") 106 formed from an electrically conductive metal, such as a self-passivating transition metal, and the second connector 104 includes a plurality of second contacts ("CONTACTS") 108 formed from an electrically conductive metal (e.g., the self-passivating transition metal). As an example, the self-passivating transition metal can be niobium, or any other of a variety of transition metals (e.g., tantalum, titanium, zirconium, molybdenum, ruthenium, rhodium, palladium, hafnium, tungsten, rhenium, osmium, and iridium). As an example, the first and second contacts 106 and 108 can each extend axially in parallel with an axis of the respective first and second connectors 102 and 104. Therefore, when the first and second connectors 102 and 104 are joined to form a mated pair, the first and second contacts 106 and 108 can slide along each other along respective surfaces to form an electrically conductive coupling.

In the example of FIG. 1, the connectors 102 and 104 are demonstrated as fastened together, such as by fasteners (not shown), to form the electrical connector system 100, as demonstrated by a dotted line 110. Additionally, as described in greater detail herein, the first and second connectors 102 and 104 can each include keying features to ensure corresponding electrical coupling of the first and second contacts 106 and 108. Each of the sets of contacts 106 and 108 are demonstrated as being coupled, respectively, to a respective set of conductors (e.g., wires) 112 and 114 that are each configured to propagate power or AC signals, demonstrated in the example of FIG. 1 as a signal SIG. For example, the conductors 112 and 114 can be provided in respective cables that are coupled to the respective first and second connectors 102 and 104. Therefore, when the connectors 102 and 104 are fastened together, each of the first contacts 106 is coupled to a respective one of the second contacts 108 to provide electrical connection between the first and second contacts 106 and 108. As a result, the signals SIG can propagate between the sets of conductors 112 and 114 via the respective sets of electrically-connected first and second contact pairs 106 and 108.

Additionally, in the example of FIG. 1, the first connector 102 includes a plurality of pliable contact guides ("CONTACT GUIDES") 116 and the second connector 104 includes a plurality of support guides ("SUPPORT GUIDES") 118. Each of the contact guides 116 is associated with a respective one of the first contacts 106 and each of the support guides 118 is associated with a respective one of the second contacts 108. As an example, in response to the first and second connectors being joined to form a mated pair, the contact guides 116 can be arranged to provide contact pressure to a first surface of the respective second contact 108 to provide electrical connectivity of a second surface of the second contact 108, opposite the first surface, with an adjoining surface of the first contact 106. For example, the contact guides 116 include a tapered or non-linear leading edge (e.g., at a distal end) that is configured to contact the respective second contact 108 when the first and second connectors 102 and 104 are joined to form a mated pair. The tapered or non-linear leading edge can thus facilitate elastic motion of the contact guide 116 from a first position prior to contact with the edge of the second contact 108 to a second position over an edge of the second contact 108 and in contact with the first surface of the second contact 108 as the second contact 108 slides along the first contact 106. The contact guides 116 can thus provide contact pressure on the first surface of the second contact 108 to provide a biasing force of the second contact 108 onto the first contact 106 to provide electrical connectivity of a second surface of the second contact 108, opposite the first surface, with an adjoining surface of the first contact 106.

The support guides 118 can each be configured to provide contact with the respective contact guide 116 (e.g., at a portion along the length of the contact guide 116) as the first and second connectors 102 and 104 are joined to form the mated pair, such as at an extreme position or a locked position. As an example, the support guide 118 can be formed from a rigid material that is coupled in a fixed manner to a housing of the respective second connector 104. Therefore, the support guide 118 can press down on the contact guide 116 to facilitate the contact pressure as a predetermined force to the first surface of the second contact 108 via the contact guide 116.

As a result, as described in greater detail herein, the electrical connection of the first and second contacts 106 and 108 can be sufficient based on mitigating the inhibition of the power or AC signal propagating between the first and second contacts based on a dielectric film and/or poor surface contact between the first and second contacts 106 and 108. For example, upon fastening of the first and second connectors 102 and 104, at least one fluid channel can be formed in the electrical connector system 100, such as between electrically-connected sets of the contacts 106 and 108. When submerged in fluid (e.g., water), the self-passivating transition metal contacts 106 and 108 develop a dielectric film that acts as a high-capacitance capacitor between the respective contacts 106 and 108 and the associated fluid. The dielectric film can provide a barrier that can inhibit electrical connectivity between the first and second contacts 106 and 108. Additionally, self-passivating transition metals can be relatively soft and pliable, and can therefore provide unpredictable electrical coupling between contacts.

Based on the provided biasing force in response to the contact pressure provided from the contact guides 116, the dielectric film can be scraped from the adjoining surface of the respective first and second contacts 106 and 108, and the first and second contacts 106 and 108 can be pressed together to provide uniformity of electrical contact as the first and second connectors 102 and 104 are joined to form the mated pair. As a result, the electrical connection of the first and second contacts can be sufficient based on mitigating the inhibition of the power or AC signal propagating between the first and second contacts 106 and 108 based on the dielectric film and/or poor surface contact.

Figure 2:
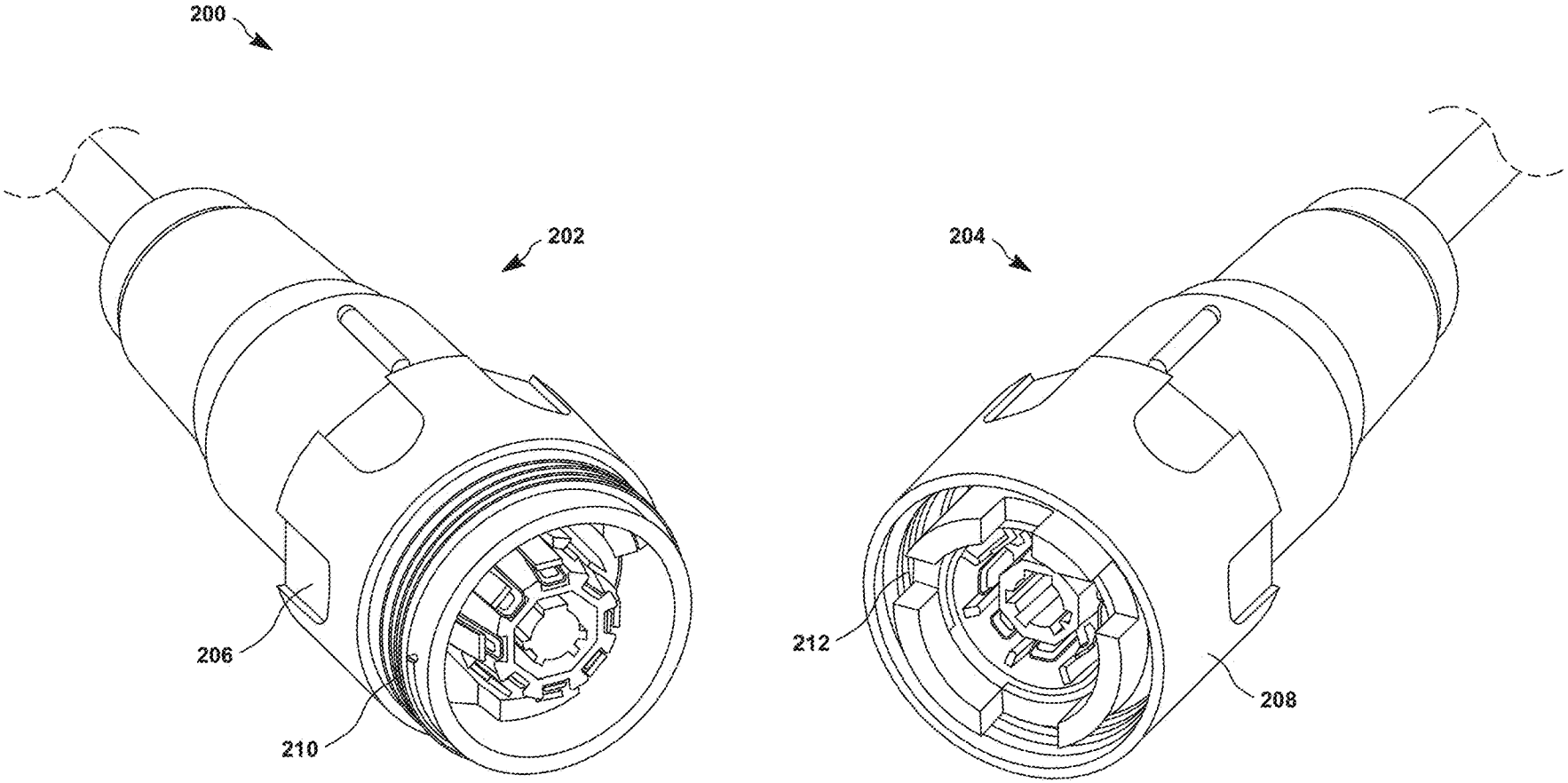
FIG. 2 illustrates an example of an electrical connector system.

FIG. 2 an example of an electrical connector system 200. The electrical connector system 200 includes a connector 202 and a connector 204. The connectors 202 and 204 can each correspond to the respective connectors 102 and 104 in the example of FIG. 1. Therefore, reference is to be made to the example of FIG. 1 in the following description of the examples of FIG. 2.

The connectors 202 and 204 are each demonstrated as renderings of connectors. The connector 202 is demonstrated as including an exterior housing 206 that substantially surrounds the first contacts 106 and the contact guides 116 therein. Similarly, the connector 204 is demonstrated as including an exterior housing 208 that substantially surrounds the second contacts 108 and the support guides 118 therein. In the example of FIG. 2 and as described in greater detail herein, the first and second contacts 106 and 108 can be arranged in the first and second connectors 202 and 204 as disposed in a polar array with respect to a cross-section perpendicular to an axis of the respective first and second connectors 202 and 204. As another example, the first and second contacts 106 and 108 can extend axially in parallel with an axis of the respective first and second connectors 202 and 204.

In the example of FIG. 2, the housings 206 and 208 each include a fastener to facilitate fastening the connectors 206 and 208 together as a mated pair to form the electrical connector system 200. In the example of FIG. 2, the fastener of the first connector 202 is demonstrated as an inner thread pattern 210 and the fastener of the second connector 204 is demonstrated as an outer thread pattern 212. Therefore, the connectors 202 and 204 can be screwed together via the thread patterns 210 and 212 to provide electrical connection of the respective first and second contacts 106 and 108. As another example, the connectors 202 and 204 can be screwed together via the thread patterns 210 and 212 to form channels that can fill with fluid (e.g., water). Based on the thread patterns 210 and 212 and based on the polar array arrangement of the contacts disposed therein, respectively, the fastening of the connectors 202 and 204 can provide for a substantially uniform biasing force between the first and second contacts 106 and 108 of the respective connectors 202 and 204.

While the example of FIG. 2 demonstrates the fasteners as the thread patterns 210 and 212, the electrical connector system 100 described in the example of FIG. 1 and elsewhere herein is not limited to threaded connections for fastening the respective connectors 102 and 104. For example, the connectors 102 and 104 can include a variety of fastener types (e.g., snap-fit) that are designed to provide a joined state of the connectors 102 and 104. Additionally, the connectors 102 and 104 can include any of a variety of geometries of the contacts 106 and 108 and/or the contact guides 116. Accordingly, the electrical connector system 100 is not limited to as described herein.

Figure 3:
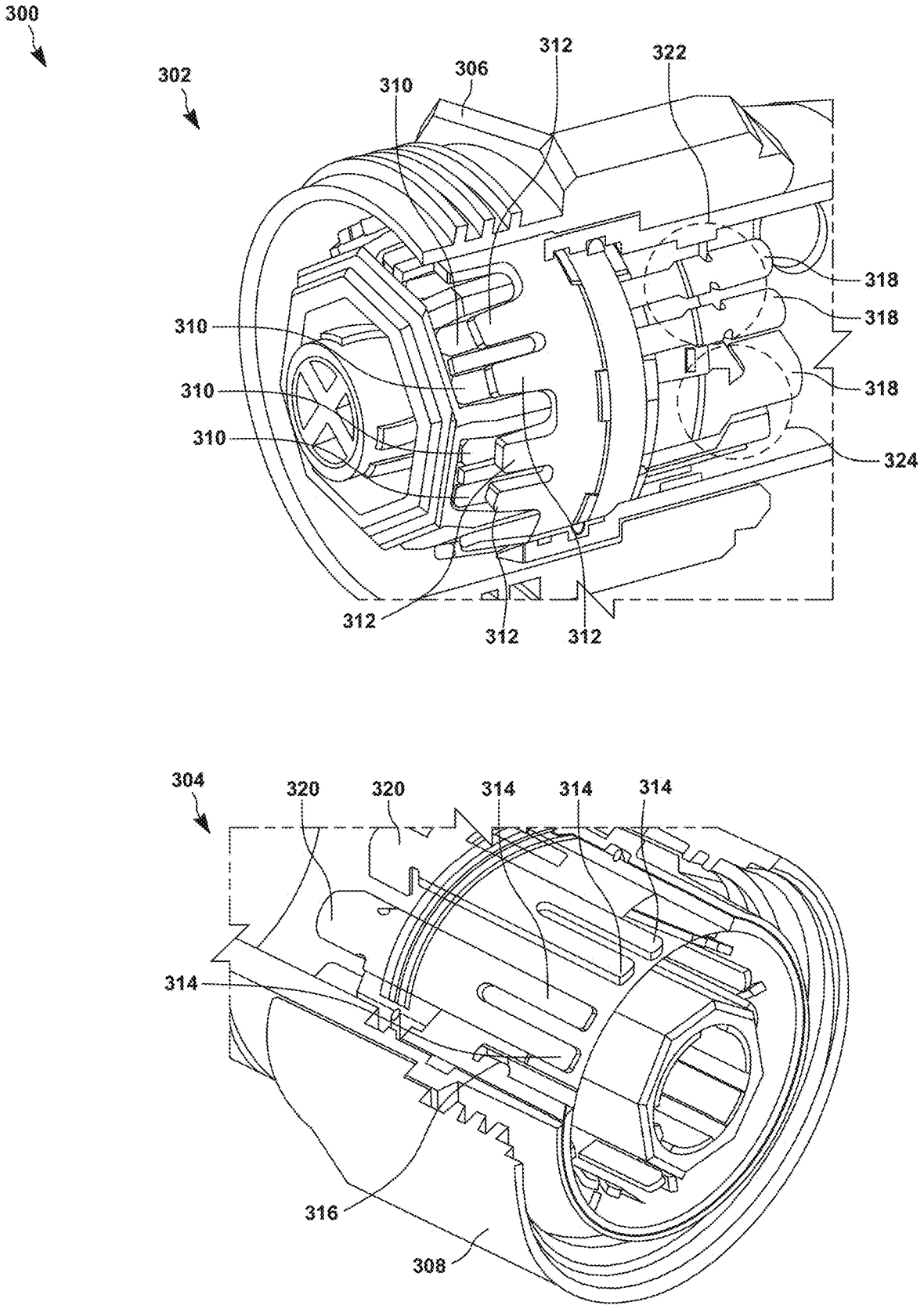
FIG. 3 illustrates another example an electrical connector system.

FIG. 3 illustrates another example an electrical connector system 300. The electrical connector system 300 includes a first connector 302 and a second connector 304. The first and second connectors 302 and 304 can each correspond to the respective connectors 102 and 104 in the example of FIG. 1. Therefore, reference is to be made to the example of FIG. 1 in the following description of the examples of FIG. 3.

The connectors 302 and 304 are each demonstrated as renderings of connectors. The first connector 302 is demonstrated as including an exterior housing 306 that is partially missing in the example of FIG. 3 to provide an interior view of the first connector 302. Similarly, the second connector 304 is demonstrated as including an exterior housing 308 that is partially missing in the example of FIG. 3 to provide an interior view of the second connector 304.

The first connector 302 includes the first contacts 310 and the contact guides 312 disposed within the exterior housing 306, and the second connector 304 includes the second contacts 314 and the support guides 316 disposed within the exterior housing 308. In the example of FIG. 3, the first contacts 310 are conductively coupled to (e.g., integral with) wire connections 318 that are configured to conductively couple to conductors (e.g., wires) that can extend in an associated cable to which the first connector 302 is associated. Similarly, the second contacts 314 are conductively coupled to (e.g., integral with) wire connections 320 that are configured to conductively couple to conductors (e.g., wires) that can extend in an associated cable to which the second connector 304 is associated.

As described previously, each of the respective first and second contacts 310 and 314 can be configured to propagate a power signal or an AC signal. At 322, the wire connections 318 are demonstrated as having a one-to-one relationship with the respective first contacts 310, such that, as one example, each of the first contacts 310 is associated with a single one of the wire connections 318. Therefore, corresponding wire connections 320 can have the one-to-one relationship with the respective second contacts 314 (not shown in the example of FIG. 3), such that each of the second contacts 314 is associated with a single one of the wire connections 320. As a second example, at 324, a pair of adjacent first contacts 310 are demonstrated as conductively coupled to (e.g., integral with) a single wire connection 318, such that the pair of adjacent first contacts 310 can propagate the power signal in the associated wire. As a result, high amplitude currents can be split between the adjacent first contacts 310 to mitigate overcurrent conditions on a given conductive connection between the first and second contacts 310 and 314. The second connector 304 can thus similarly include a corresponding adjacent pair of adjacent second contacts 314 conductively coupled to (e.g., integral with) the single wire connection 320, such that the corresponding pair of adjacent second contacts 314 can likewise propagate the power signal in the associated wire.

Figure 4:
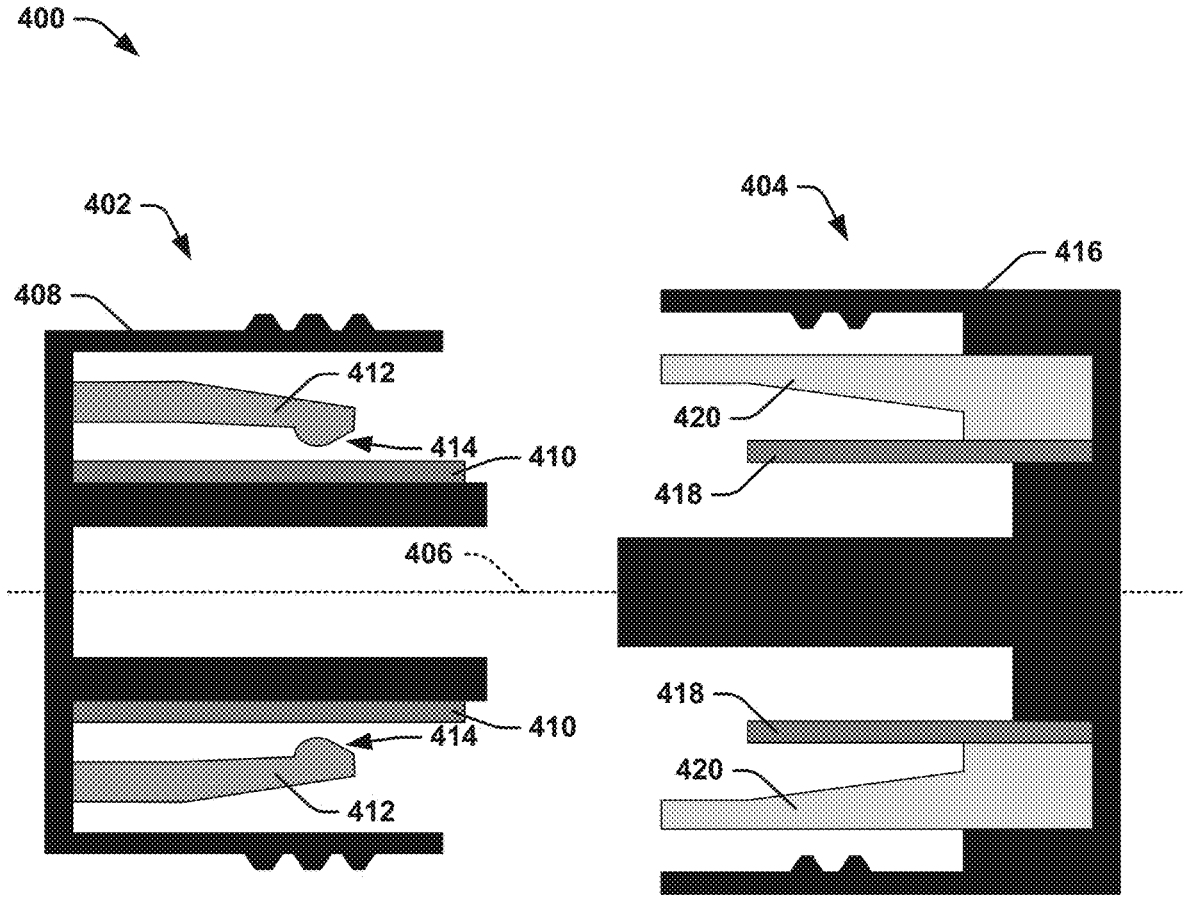
FIG. 4 illustrates an example cross-sectional diagram of an electrical connector system.

FIG. 4 illustrates an example cross-sectional diagram 400 of an electrical connector system. The diagram 400 demonstrates a first connector 402 and a second connector 404 that can correspond to the first and second connectors 102 and 104, 202 and 204, or 302 and 304, respectively, in the examples of FIGS. 1-3. The first and second connectors 402 and 404 are demonstrated in a cross-sectional view along a central axis 406. In the example of FIG. 4, the first and second connectors 402 and 404 are demonstrated as unconnected (uncoupled).

The first connector 402 includes housing and support structures 408, which are indicated by solid black. As an example, the housing and support structures 408 can include the external housing, fixed support structures, a fastener (e.g., inner threading), and at least one keying structure, as described in greater detail herein. The first connector 402 also includes the first contacts 410 and the contact guides 412. The first contacts 410 and the contact guides 412 are each demonstrated as pairs that are arranged opposite the central axis 406, such that the first contacts 410 and the contact guides 412 can be arranged in a polar array that surrounds the central axis 406. As an example, the first contacts 410 and the contact guides 412 can each number sixteen in quantity. While the first contacts 410 and the respective contact guides 412 are demonstrated in a polar array, other arrangements or arrays of the first contacts 410 and the respective contact guides 412 are possible.

In the example of FIG. 4, the contact guides 412 are demonstrated in a first position that can correspond to a spring null position. The first position can thus correspond to a stationary position at which the elasticity of the material from which the contact guides 412 are formed is at rest. In the example of FIG. 4, each of the contact guides 412 includes a leading edge 414 at a distal end of the contact guides 412 relative to the housing and support structures 408. In the example of FIG. 4, the leading edge 414 of the contact guides 412 is rounded, and thus non-linear. Alternatively, the leading edge 414 can be tapered, beveled, or in another arrangement that is not perpendicular with respect to the plane of the surface of the first contacts 410.

Similar to the first connector 402, the second connector 404 includes housing and support structures 416, which are indicated by solid black. Similar to the first connector 402, the housing and support structures 416 can include the external housing, fixed support structures, a fastener (e.g., outer threading), and at least one keying structure, as described in greater detail herein. The second connector 404 also includes the second contacts 418 and the support guides 420. The second contacts 418 and the contact guides 420 are each demonstrated as pairs that are arranged opposite the central axis 406, such that the second contacts 418 and the support guides 420 can be arranged in a polar array that surrounds the central axis 406.

As an example, the second contacts 418 and the contact guides 420 can each number sixteen in quantity, as corresponding respectively to the first contacts 410 and the support guides 412. In the example of FIG. 4, the first and second contacts 410 and 418 extend axially in parallel with the central axis 406. For example, the first and second contacts 410 and 418 can have a rectangular cross-sectional shape, and each include a first surface that faces radially outward relative to the central axis 406 and a second surface that faces radially inward relative to the central axis 406.

Figure 5:
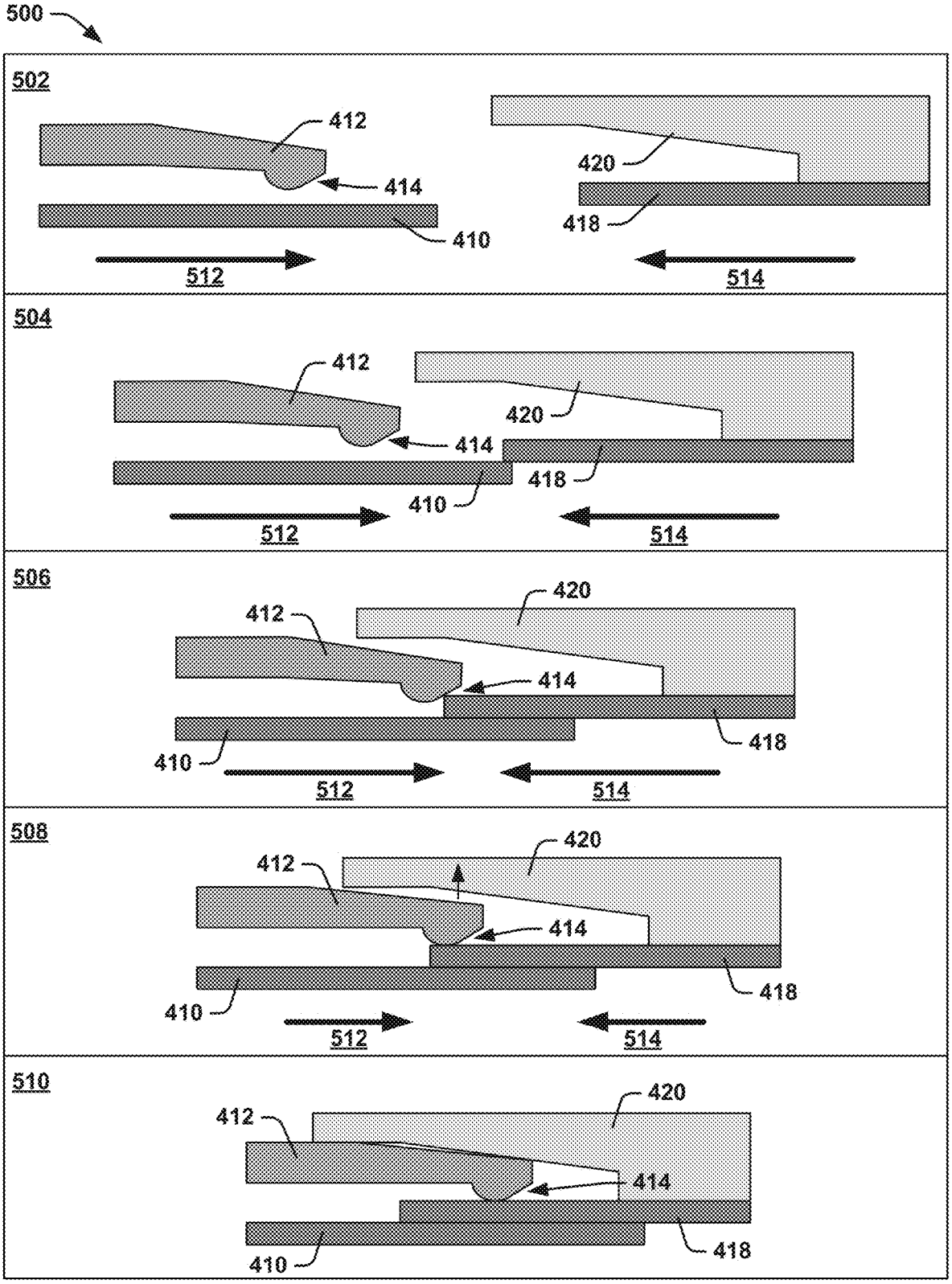
FIG. 5 illustrates another example cross-sectional diagram of an electrical connector system.

FIG. 5 illustrates an example diagram 500 of electrical connection of the first and second contacts 410 and 418. The first and second contacts 410 and 418 are each demonstrated in the diagram 500 as one of the two oppositely arranged first and second contacts 410 and 418 in the example of FIG. 4. Therefore, the diagram 500 demonstrates a portion of the electrical connector system demonstrated in the diagram 400 in the example of FIG. 4, with the remaining components omitted for simplicity. Accordingly, reference to the example of FIG. 4 is provided in the example of FIG. 5. The diagram 500 demonstrates five separate stages 502, 504, 506, 508, and 510.

In the first stage 502, the first and second connectors 402 and 404 are being brought closer together. Therefore, the first contact 410 and the contact guide 412 are brought closer to the second contact 418 and the support guide 420, as demonstrated by arrows 512 and 514, respectively. In the first stage 502, the contact guide 412 is demonstrated in the first position that can correspond to a spring null position. The first position can thus correspond to a stationary position at which the elasticity of the material from which the contact guides 412 are formed is at rest.

In the second stage 504, the first and second connectors 402 and 404 are connected via the fasteners (e.g., via the thread patterns 210 and 212, not shown in the example of FIG. 5). As the first and second connectors 402 and 404 are joined to form the mated pair via the fasteners, the first and second contacts 410 and 418 are physically joined. As described previously in the example of FIG. 4, the first and second contacts 410 and 418 extend axially in parallel with the central axis 406, with a first surface that faces radially outward relative to the central axis 406 and a second surface that faces radially inward relative to the central axis 406. Therefore, as the first and second connectors 402 and 404 are joined, the second surface of the second connector 418 can contact the first surface of the first connector 410, such that the second surface of the second connector 418 can slide along the first surface of the first connector 410 as the first and second connectors 402 and 404 are brought closer together (as indicated by the arrows 512 and 514).

In the third stage 506, the first and second connectors 402 and 404 are brought close enough together (via the arrows 512 and 514) that the leading edge 414 of the contact guide 412 in the first position collides with the edge of the second contact 418. As described above in the example of FIG. 4, the leading edge 414 of the contact guide 412 is demonstrated as non-linear or tapered. Therefore, as the first and second connectors 402 and 404 continue to be brought together (as indicated by the arrows 512 and 514), the contact of the tapered or non-linear leading edge 414 of the contact guide 412 with the edge of the second contact 418 forces the contact guide 412 to elastically move to the second position, in which the leading edge 414 moves over the edge of the second contact 418 and into contact with the first surface of the second contact 418.

In the fourth stage 508, the leading edge 414 of the contact guide 412 has elastically moved over the edge of the second contact 418 to the second position. In the second position, the contact guide 412 is lifted over the edge of the second contact 418, as indicated by the upward arrow 422, to be in contact with the first surface of the second contact 418. The leading edge of the contact guide 412 thus slides over the first surface of the second contact 418 as the first and second connectors 402 and 404 continue to be brought closer together (as indicated by the arrows 512 and 514), such as via the fasteners. Because the contact guide 412 is pliable and exhibits elasticity, the contact guide 412 can provide contact pressure on the first surface of the second contact 418. The contact pressure can thus facilitate a bias force of the second surface of the second contact 418 on the adjoining first surface of the first contact 410.

Based on the provided the biasing force of the second surface of the second contact 418 on the adjoining first surface of the first contact 410 in response to the contact pressure provided from the contact guide 412, the dielectric film that can form on the first and second contacts 410 and 418 can be scraped from the adjoining surfaces of the respective first and second contacts 410 and 418 as the first and second contacts 410 and 418 slide along and relative to each other in the directions of the arrows 512 and 514. Accordingly, the first and second contacts 410 and 418 can be pressed together to provide uniformity of electrical contact as the first and second connectors 402 and 404 are joined to form the mated pair. As a result, the electrical connection of the first and second contacts 410 and 418 can be sufficient based on mitigating the inhibition of the power or AC signal propagating between the first and second contacts 410 and 418 based on the dielectric film and/or poor surface contact.

Figure 6:
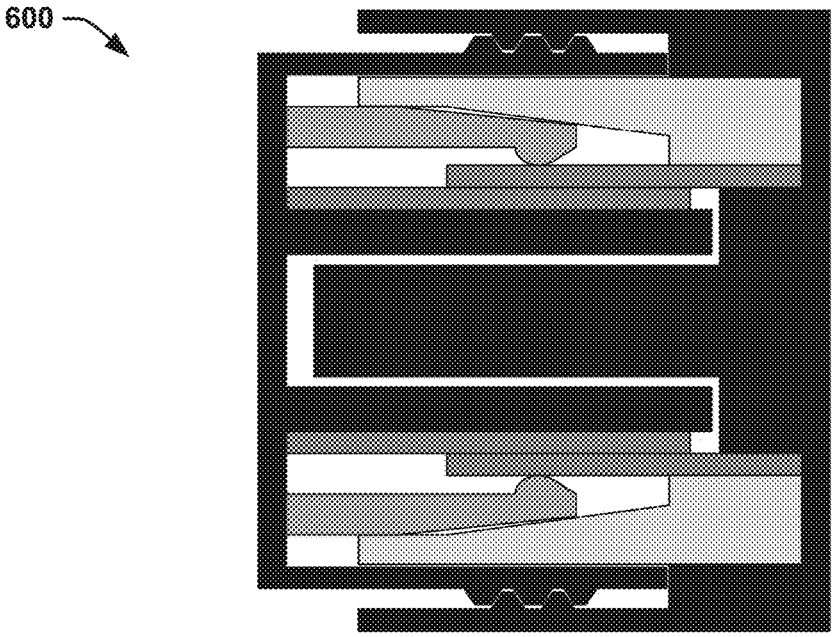
FIG. 6 illustrates another an example cross-sectional diagram of an electrical connector system.

In the fifth stage 510, the first and second connectors 402 and 404 are demonstrated as having a completed connection. As an example, the connection of the first and second connectors 402 and 404 can occur in response to a physical limit of axial motion of the first and second connectors 402 and 404 toward each other, such as based on physical barriers associated with the housing and support structures 408 and 416 (e.g., the fasteners and/or the interior molding). The completed connection of the first and second connectors is demonstrated in the example of FIG. 6, for example. FIG. 6 illustrates another an example of an electrical connector system 600, similar to the example of FIG. 4, in which the first and second connectors 402 and 404 are connected.

Referring back to the example of FIG. 5, in the fifth stage 510, at approximately the physical limit of the axial motion of the first and second connectors 402 and 404, the support guide 420 is brought into contact with the contact guide 412. The support guide 420 can therefore provide pressure on the contact guide 412 in the direction of the second contact 418. Based on the pliable characteristic of the material of the contact guide 412, the pressure provided by the support guide 420 can increase the contact pressure provided by the support guide 412 on the first surface of the second contact 418. Because the contact between the support guide 420 and the contact guide 412 occurs at approximately an axial motion limit of the first and second connectors 402 and 404, the pressure provided by the support guide 420 on the contact guide 412 can be consistent with each connection of the first and second connectors 402 and 404, and can be approximately uniform with respect to each of the contact guides 412 in the first connector 402. Accordingly, coupling of the first and second connectors 402 and 404 can provide for consistent and sufficient electrical connection between each of the respective sets of first and second contacts 410 and 418. As an example, the fasteners can control the magnitude of the normal bias force acting on the first surface of the first contact 410 resulting from the contact pressure of the contact guide 412 provided on the first surface of the second contact 418. For example, tightening the threaded connections 210 and 212 (e.g., via coupling nuts) can result in an increase in the normal bias force.

Figure 7:
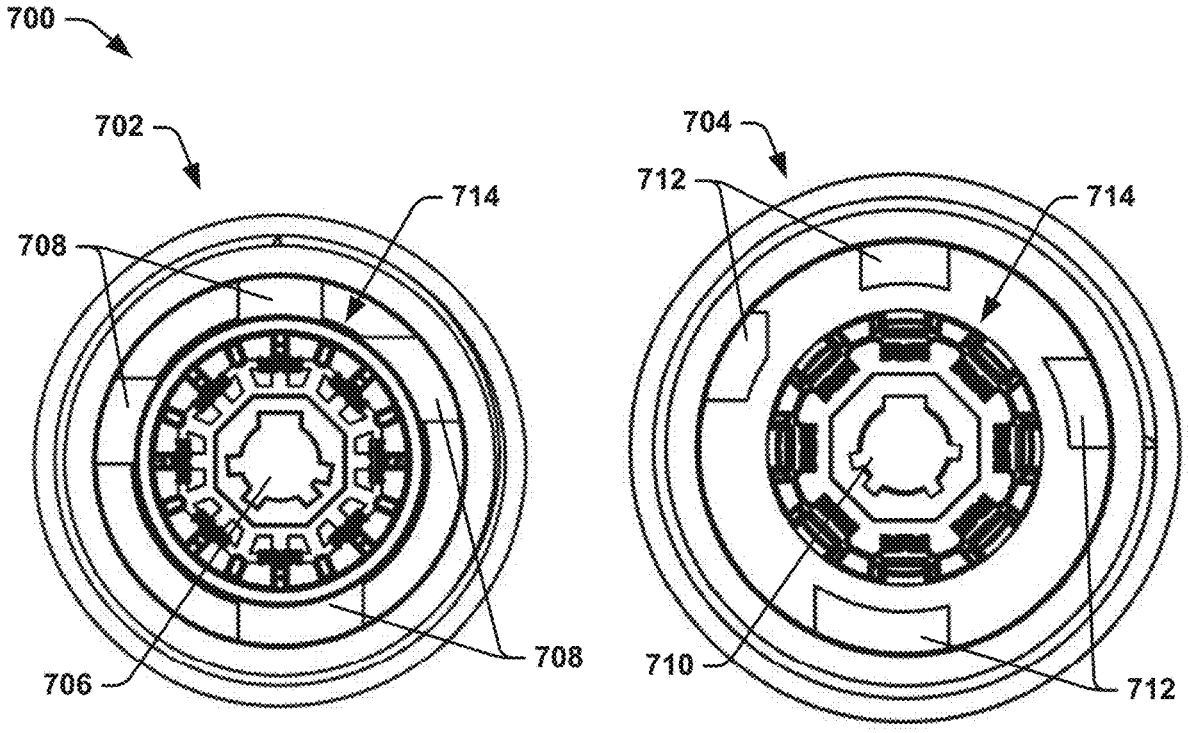
FIG. 7 illustrates another an example of an electrical connector system.

FIG. 7 illustrates another an example of an electrical connector system 700. The electrical connector system 700 includes a first connector 702 and a second connector 704 that are each demonstrated as front-facing. The first and second connectors 702 and 704 can correspond to the first and second connectors 102 and 104, 202 and 204, 302 and 304, and/or 402 and 404. Therefore, reference is to be made to the examples of FIGS. 1-6 in the following description of the example of FIG. 7.

As described previously, the first and second connectors can include keying features to ensure corresponding electrical coupling of the first and second contacts. In the example of FIG. 7, the first connector 702 includes a first set of keying features 706 and a second set of keying features 708. Similarly, the second connector 704 includes a third set of keying features 710 and a fourth set of keying features 712.

The first and third sets of keying features 706 and 710 are each demonstrated as interior to the polar array of connectors, demonstrated generally at 714 in each of the first and second connectors 702 and 704. The first set of keying features 706 and the third set of keying features 710 can be dimensioned to correspondingly fit each other for connection of the first and second connectors 702 and 704. Similarly, the second and fourth sets of keying features 708 and 712 are each demonstrated as exterior to the polar array of connectors 714 in each of the first and second connectors 702 and 704. The second set of keying features 708 and the fourth set of keying features 712 can be dimensioned to correspondingly fit each other for connection of the first and second connectors 702 and 704. By implementing two corresponding sets of keying features, the connection of the first and second connectors 702 and 704 can exhibit increased stability for maintaining the connection while providing blind-keying for an operator to provide coupling of the first and second connectors 702 and 704 in a manner to provide corresponding electrical coupling of the first and second contacts therein. For example, the two corresponding sets of keying features can provide increased stability for maintaining the connection of the electrical connector system 700 in response to forces provided normal to the central axis of the connectors.

What has been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. An electrical connector system comprising:

a first connector comprising a plurality of first contacts and a plurality of contact guides associated with the respective plurality of first contacts; and a second connector comprising a plurality of second contacts each configured to slide between a respective one of the contact guides and a respective one of the first contacts in response to joining the first and second connectors as a mated pair, such that the respective one of the contact guides provides contact pressure to a first surface of a respective one of the second contacts to provide a biasing force of the respective one of the second contact contacts onto the respective one of the first contact contacts to electrically couple a second surface of the respective one of the second contacts opposite the first side to an adjoining surface of the respective one of the first contacts to conduct a signal between the respective one of each of the first and second contacts.

2. The system of claim 1, wherein the second connector further comprises a plurality of support guides, such that each of the support guides provides contact with a respective one of the contact guides in response to joining the first and second connectors as the mated pair to provide the contact pressure to the respective one of the second contacts via the respective one of the contact guides.

3. The system of claim 1, wherein each of the contact guides comprises one of a tapered and non-linear leading edge configured to contact an edge of the respective one of the second contacts to elastically move the respective one of the contact guides from a first position to a second position that is over the edge and in contact with the first surface of the respective one of the second contacts to provide the contact pressure as the first and second connectors are joined as the mated pair.

4. The system of claim 1, wherein each of the first and second contacts are configured to conduct one of a power signal or an alternating current (AC) signal.

5. The system of claim 4, wherein a pair of adjacent first contacts can each be electrically coupled to a first wire in a cable associated with the first connector to propagate the power signal, and wherein a corresponding pair of adjacent second contacts can each be electrically coupled to a second wire in a cable associated with the second connector to propagate the power signal.

6. The system of claim 1, wherein the first connector comprises a plurality of first keying features and a plurality of second keying features, wherein the second connector comprises a plurality of third keying features and a plurality of fourth keying features, wherein the first keying features are arranged to mate with the third keying features and the second keying features are arranged to mate with the fourth keying features in response to joining the first and second connectors as the mated pair.

7. The system of claim 6, wherein the first and third keying features are arranged in a cross-sectional region of the first and second connectors, respectively, such that the first and second contacts, respectively, surround the first and third keying features, wherein the second and fourth keying features are arranged in a cross-sectional region of the first and second connectors, respectively, such that the second and fourth keying features surround the first and second contacts, respectively.

8. The system of claim 7, wherein each of the first and second connectors are arranged in a circular cross-section, such that the first and second contacts, respectively, are arranged in a polar array about the circular cross-section of the first and second connectors, wherein the first and third keying features are arranged radially inside the polar array and the second and fourth keying features are arranged radially outside the polar array.

9. The system of claim 1, wherein the first and second contacts are formed from a self-passivating transition metal, wherein the first connector comprises a first housing and the second connector comprises a second housing, wherein the first and second housings are configured to be coupled to substantially enclose the signal connector and to create at least one fluid-filled channel between each of the electrically-connected first and second contact pairs in response to fastening the first and second connectors while submerged in a respective fluid to provide a resistive path in the at least one fluid-filled channel for providing signal isolation between each of the electrically-connected first and second contact pairs.

10. The system of claim 9, wherein the first housing comprises an inner thread pattern and the second housing comprises an outer thread pattern, such that each electrically-connected set of the first and second contacts can have an approximately equal contact pressure in response to joining the first and second connectors as the mated pair.

11. An electrical connector system comprising:

a first connector comprising a plurality of first contacts formed from a metal and a plurality of contact guides associated with the respective plurality of first contacts; and a second connector comprising a plurality of second contacts formed from the metal and a plurality of support guides, wherein each of the second contacts are configured to slide between a respective one of the contact guides and a respective one of the first contacts in response to joining the first and second connectors as a mated pair, such that each of the support guides provides contact with a respective one of the contact guides in response to joining the first and second connectors as a mated pair to provide contact pressure via the respective one of the contact guides to a first surface of the respective one of the second contacts to provide a biasing force of a respective one of the second contact contacts onto a respective one of the first contact contacts to electrically couple a second surface of the respective one of the second contacts opposite the first side to an adjoining surface of the respective one of the first contacts to conduct a signal between the respective one of each of the first and second contacts.

12. The system of claim 11, wherein each of the contact guides comprises one of a tapered and non-linear leading edge configured to contact an edge of the respective one of the second contacts to elastically move the respective one of the contact guides from a first position to a second position that is over the edge and in contact with the first surface of the respective one of the second contacts to provide the contact pressure as the first and second connectors are joined as the mated pair.

13. The system of claim 11, wherein the first connector comprises a plurality of first keying features and a plurality of second keying features, wherein the second connector comprises a plurality of third keying features and a plurality of fourth keying features, wherein the first keying features are arranged to mate with the third keying features and the second keying features are arranged to mate with the fourth keying features in response to joining the first and second connectors as the mated pair.

14. The system of claim 13, wherein the first and third keying features are arranged in a cross-sectional region of the first and second connectors, respectively, such that the first and second contacts, respectively, surround the first and third keying features, wherein the second and fourth keying features are arranged in a cross-sectional region of the first and second connectors, respectively, such that the second and fourth keying features surround the first and second contacts, respectively.

15. The system of claim 11, wherein the first and second contacts are formed from a self-passivating transition metal, wherein the first connector comprises a first housing and the second connector comprises a second housing, wherein the first and second housings are configured to be coupled to substantially enclose the signal connector and to create at least one fluid-filled channel between each of the electrically-connected first and second contact pairs in response to fastening the first and second connectors while submerged in a respective fluid to provide a resistive path in the at least one fluid-filled channel for providing signal isolation between each of the electrically-connected first and second contact pairs.

16. An electrical connector system comprising:

a first connector comprising a first housing, a plurality of first contacts formed from a self-passivating transition metal, and a plurality of contact guides associated with the respective plurality of first contacts; and a second connector comprising a second housing and a plurality of second contacts formed from the self-passivating transition metal and each of the second contacts configured to slide between a respective one of the contact guides and a respective one of the first contacts in response to joining the first and second connectors via the first and second housings as a mated pair, such that the respective one of the contact guides provides contact pressure to a first surface of a respective one of the second contacts to provide a biasing force of the respective one of the second contact contacts onto the respective one of the first contact contacts to electrically couple a second surface of the respective one of the second contacts opposite the first side to an adjoining surface of the respective one of the first contacts to conduct a signal between the respective one of each of the first and second contacts, wherein the first and second housings are configured to substantially enclose the electrical connector system and to create at least one fluid-filled channel between each of the electrically-connected first and second contact pairs in response to joining the first and second connectors via the first and second housings as the mated pair while submerged in a respective fluid to provide a resistive path in the at least one fluid- filled channel for providing signal isolation between each of the electrically-connected first and second contact pairs.

17. The system of claim 16, wherein the second connector further comprises a plurality of support guides, such that each of the support guides provides contact with a respective one of the contact guides in response to joining the first and second connectors as the mated pair to provide the contact pressure to the respective one of the second contacts via the respective one of the contact guides.

18. The system of claim 16, wherein the first connector comprises a plurality of first keying features and a plurality of second keying features, wherein the second connector comprises a plurality of third keying features and a plurality of fourth keying features, wherein the first keying features are arranged to mate with the third keying features and the second keying features are arranged to mate with the fourth keying features in response to joining the first and second connectors as the mated pair.

19. The system of claim 18, wherein the first and third keying features are arranged in a cross-sectional region of the first and second connectors, respectively, such that the first and second contacts, respectively, surround the first and third keying features, wherein the second and fourth keying features are arranged in a cross-sectional region of the first and second connectors, respectively, such that the second and fourth keying features surround the first and second contacts, respectively.

20. The system of claim 16, wherein the first housing comprises an inner thread pattern and the second housing comprises an outer thread pattern, such that each electrically-connected set of the first and second contacts can have an approximately equal contact pressure in response to joining the first and second connectors as the mated pair.

* * * * *